United States Patent [19]

D'Agnolo et al.

[11] 4,354,343

[45] Oct. 19, 1982

[54] AUTOMATIC TAKE-IN FOR DOUBLE-TWISTING SPINDLES

[75] Inventors: Armando D'Agnolo, Porcia; Luigi Colli; Ugo Gaiotti, both of Pordenone, all of Italy

[73] Assignee: Officine Savio S.p.A., Pordenone, Italy

[21] Appl. No.: 190,187

[22] Filed: Sep. 24, 1980

[30] Foreign Application Priority Data

Sep. 24, 1979 [IT] Italy ..... 83456 A/79

[51] Int. Cl.[3] ..... D01H 15/00; D01H 7/86

[52] U.S. Cl. ..... 57/279; 57/58.7; 57/58.86

[58] Field of Search ..... 57/58.49, 58.83–58.86, 57/58.7, 279, 280

[56] References Cited

U.S. PATENT DOCUMENTS 4,168,605 9/1979 D'Agnolo ..... 57/279
4,199,929 4/1980 Vessela ..... 57/279
4,287,712 9/1981 Franzen ..... 57/279

FOREIGN PATENT DOCUMENTS 651573 8/1964 Belgium .
2309578 9/1974 Fed. Rep. of Germany .
2734220 2/1979 Fed. Rep. of Germany .
2398131 2/1979 France .

*Primary Examiner*—John Petrakes
*Attorney, Agent, or Firm*—Stevens, Davis, Miller & Mosher

[57] ABSTRACT

The invention provides an injector having a suitably formed head which can partially penetrate through a lateral aperture in a spindle into the vicinity of a chamber containing an expansible capsule.

Penetrating into the chamber, the injector laterally displaces the capsule and by injecting through a beak a fluid under pressure creates in the axial passage a negative-positive pressure necessary for transporting the filament.

In the vicinity of the chamber there can advantageously be provided a mobile section which is circumferentially displaceable by a projection which is included on the head of the injector, when the injector penetrates or is penetrating the spindle.

The injector is further provided with an arm which may be pivoted in the vicinity of the balloon container or on an auxiliary bench.

9 Claims, 11 Drawing Figures

AUTOMATIC TAKE-IN FOR DOUBLE-TWISTING SPINDLES

The present invention relates to an automatic take-in device for double twisting spindles as well as double twisting spindles equipped with said take-in.

The object of the present invention is directed to double-twisting spindles for permitting the pneumatic threading of the filament by suction-ejection effect created substantially by the automatic take-in device advantageously and at least temporarily cooperating with the spindle.

Advantageously but not exclusively, the present invention is addressed to double twisting spindles utilizing an expanding olive (bead) tensioning device for adjusting the filament tension or equipped with similar tension adjustment devices such as a pair of spheres or cylinders or the like.

Such devices, experience has shown, offer a greater reliability and adjustment constant control, are, normally but not necessarily, positioned in that portion of the axial conduit provided in the stationary part of the spindle, that is because by doing so it is possible to adjust from above, with maximum simplicity, the working pressure of the capsule and consequently the tension which the capsule could exert on the filament.

In the case where similar devices are used, it is the masses placed on top or underneath thereof, where such devices are not provided with their own elastic thrust means, that generate the required elastic reaction.

Double twisting spindles equipped with pneumatic threading of filaments are known.

In these spindles the suction-ejection effect is created substantially by a device, for example a venturi nozzle, placed in most cases within the spindle itself or on top of the filament entry mouth or on the base of the rotating part.

DE 2.035.025 and 2.065.140 teach how to thread the filament into a double twisting spindle by using a fluid under pressure operating in the spindle's base and in cooperation with the rotating part.

This system requires the use of means for positioning the rotating part, which are per se rather complicated.

In addition, the compressed air feed device is in itself very complex and costly, the whole can also be subjected to frequent maintenance.

DE 2.408.563 provides a complicated compressed air feed device which must generate the required depression and thus the withdrawal of the filament.

Neither this teaching nor the previous ones teach how a double twisting spindle can be made to work without filament braking means and, if these means are provided, how the proposed devices function since the braking means, if they are of the capsule type, but also in the other cases, would oppose the negative pressure suction effect generated according to the teachings.

In DE 2.461.796, a further teaching proposes a venturi device positioned in the stationary part of the spindle.

This teaching requires a complex, delicate device full of technical problems related to the pneumatic and hydraulic (lubrification oil) sealing without further teaching as how to actuate the eventual filament tension adjustment means during the pneumatic threading means.

DE 2.733.318 teaches how to introduce the air in a way different from that of DE 2.461.796 by proposing that the air be blown by a nozzle descending from above.

This application, in consequence to the opposition of the patent DE 2.461.796 cited during the concession procedure, does not add anything more than a simple precautionary proposal and does not indicate either the means for actuating the nozzle, nor the filament tension adjustment means, nor even how to actuate such means had they been provided.

On the other hand, it is not even understood how could such tension adjustment means be envisaged in a spindle of the type proposed.

DE 2.811.583 proposes an injector embodied in the rotating part which benefits from a relevant air flux.

This proposal has all the restrictions indicated hereinabove without a single concrete advantage.

DE 1.760.264 envisages a system of lifting the yarn by compressed air, the provision having all the limitations of DE 2.035.052.

DE 2.541.690 and DE 2.559.423 provide two guns capable of issuing compressed air which drags along therewith the filament to be threaded.

Although versatile, this solution has the limitations of an air-feeding flying tube which must run around the machines.

All these solutions have an indisputable defect, that of not providing (it itself being indispensable in most cases) a system for adjusting the filament tension.

In addition, if a filament tension adjustment device was proposed or capsules or similar means were to be employed, it is not easy to understand how it could be de-activated and it would be even more obscure if an expansible capsule or its equivalent were used.

Furthermore, the known prior art patents cited herein, require that for already set-up machines to be equiped with such devices the entire spindle must be changed.

In addition they are complicated and intricate.

They also complicate considerably the design of the spindle itself causing possible subsequent functioning difficulties.

The prior art teaches also the use of expansible capsules (beads) and spheres for braking and regulating the filament.

Such known techniques also provide some devices suitable for eliminating, at least temporarily, the action of such expansible capsules and such spheres in order to permit the passage of the filament in the threading stage of the same.

The BE 651.573 provides a sphere positioned in a special chamber envisaged in the stationary part of the spindle.

A magnet is brought in cooperation with the sphere by axially acting on a component of the stationary part.

The magnet laterally withdraws the sphere freeing thus the filament conduit.

This system has many drawbacks, among which are the magnetization of the sphere and other parts by the magnet; the fact that the introduction of the filament must be preceded by a manual action exerted on a component of the spindle; and the non-adaptability to a simplified system of filament threading.

The DE-OS 2.309.578 proposes a clever system for deactivating the action of the expansible capsule by a pressure effect which displaces the capsule in cooperation with a magnet, and by simultaneously extending the chamber the elastic effect is removed.

This system has all the drawbacks cited above in addition to the disadvantage inherent to an ingenious but complex system, i.e. a device, among other things that does not facilitate the work of the operator.

The FR 2.398.131 provides another ingenious mechanism with two expansible capsules cooperating with a slide valve elastically pushed and laterally actuable by the same compressed air that serves for threading the filament.

Also this mechanism is relevant but, beside a considerable inherent complexity in the same, has numerous disadvantages.

A first disadvantage is derived from the scraping action the slide valve exerts on the head of the capsules, thus very rapidly reducing its performance.

A second disadvantage is due to the action exerted by the capsules in cooperation with the slide valve, which action is of difficult regulation and in any case not constant with time.

A further drawback is the dimension the spindle must have.

Additionally it must be pointed out that the action of the overturnable head may not be effective due to the way it is made to work and the considerable dispersion that take place for displacing the slide valve.

It is to be further pointed out that the action on the slide valve, due to the above, can not be effective since it would be pulsating.

In DE-OS 2.734.220 a set of venturi nozzles are provided, but these have been in themselves known for a long time and in any case are irrelevant to the purpose of this invention.

Also not relevant is how the air jet coacts with the filament conduit.

The present invention attempts to obviate all these drawbacks and offers numerous advantages as could be seen from the numerous scopes proposed of which the advantages are clearly consequential effects.

The present invention attemps to tackle in a new way the threading of the filament in a double-twisting spindle which allows the operator to control, with ease, the operation while having both hands available for the task.

One first advantage is the fact that the invention is installable in whichever type of spindle after replacing, if that is necessary at all, only one portion of the stationary part.

It is also an advantage that it is not necessary to preposition the rotating part of the spindle, since the stationary part is already prepositioned.

A further advantage is offered by the possibility of installing the feed arm wherever it is positionable best without specific positioning problems.

An advantage is also the extreme simplicity of the solution which obviates the risk of maintenance.

A further advantage is the rapidity and precision of the operation, adjustment and setting-up.

According to the present invention, the expansible olive or bead is positioned in the upper part of the spindle, or on the head of the stationary part, above the area occupied by the reel and advantageously above the terry.

According to the invention the upper part of the spindle is equiped with normal and known systems for regulating the action of the capsule or any similar means used in its place.

In cooperation with the position of the capsule an openable window is provided in the body of the stationary part of the spindle; through which an automatic fluid feeder or injector is inserted.

The injector which according to the invention temporarily and at least partially penetrates into the neighborhood of the expansible capsule within the spindle, temporarily and at least partially displaces the capsule itself.

The displacement of the capsule by the automatic injector is direct.

The temporary and at least partial displacement of the capsule frees at least partially, at least one of the two contact areas between the axial bore, head and capsule.

By making the injector issue a jet of fluid under pressure directed towards the spindle's base and in cooperation with the axial bore in which the filament passes, the negative-positive pressure effect necessary for the threading of the filament is obtained.

The created effect obtained is such that the filament manages to climb on the side of the balloon limiter and between the same and the protection cage.

The applicant has made many investigations and tests on this point and obtained few solutions which make substantial use of the basic solution concept as expressed in the present invention.

According to the invention, the injector may be in itself a nozzle capable of creating the venturi effect by its own means including also the depression conduit at least in a limited axial portion thereof.

According to an alternative embodiment, the injector is a nozzle which axially cooperates with the axial bore provided in the spindle for the passage of the filament.

According to another alternative embodiment, the injector is a nozzle which cooperates with the periphery of the axial bore provided in the spindle for the passage of the filament.

According to the invention, the injector in penetrating into the chamber where the capsule, or its equivalent, is housed, can cause the displacement of eventual plug means which normally closes the entry opening during the normal work cycle of the spindle.

According to the invention, the injector can occupy a substantially central and limited zone in which the capsule is housed, but can also be formed such as to free only one part thereof and from one side only.

This is to prevent the filament, which may temporarily collapse in the threading phase, from gathering around the injector itself.

Further in accordance with the present invention the automatic injector may include its own closure means for the access to the injector chamber during the injection.

Thus the present invention is embodied by an automatic injector for double twisting spindles, having means for the required tensioning of the filament being twisted which means temporarily free the filament conduit of the filament itself during the threading stage, characterised by including an injector temporarily insertable into the spindle's body above at least one of the reels to be doubled, there being advantageously, in the neighborhood of the area in which the injector is temporarily inserted, tensioning means for the filament to be doubled, said tensioning means being temporarily and at least partially dispaceable sideways by said injector for freeing such filament conduit.

With the help of the attached drawings, a more detailed description of the invention with some non-limiting embodiments of the is given by way of example only.

The drawings show the following:

Figure 1:
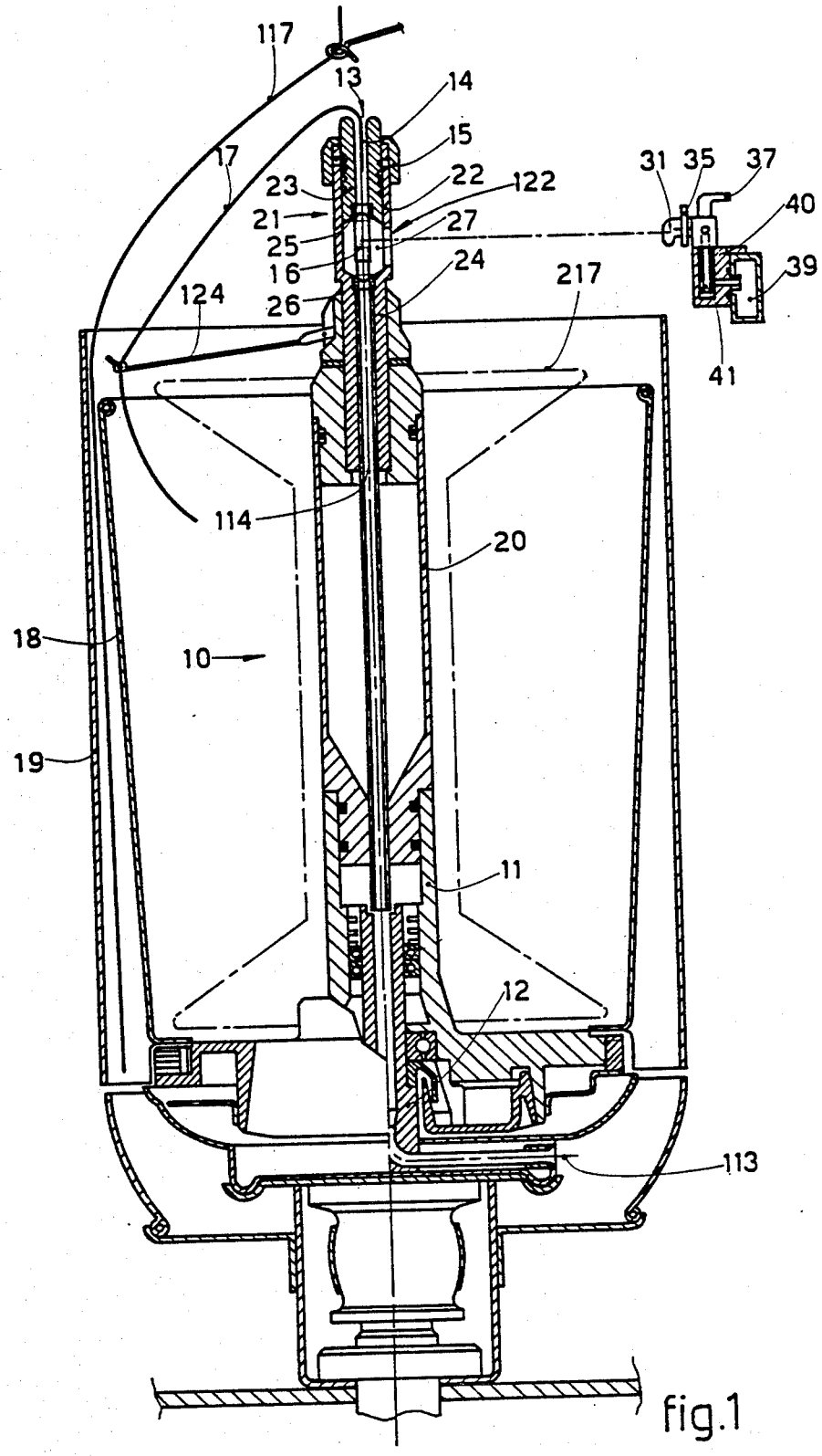
FIG. 1 is a vertical section of a double twisting spindle provided a device according the invention.

The drawings show that 10 is generally a double twisting spindle of any known type describing in detail only those parts which are of interest to the invention. Such a spindle may be vertical, horizontal or inclined with a stationary part 11 and a rotating part 12. Inlet opening 13 permits entry of the filament into the axial bore 14 which is the axial bore upstream from the capsule 16 downstream from the capsule 16 is axial bore 114 which is substantially coaxial with the bore 14. Threaded flange 15 of a known type is used for adjusting the working pressure force of the capsule 16 and consequently of the force exerted by the terminal parts of the capsule 16 on the passing filament 17. Expansible capsule 16 is made in the example by two cylindrical elements with spherical ends, one inside the other, and pushed apart by suitable elastic means provided therein.

Capsule 16, whose separation is impeded by a special edge crimping, includes advantageously therein one or more elastic elements which tends to separate the two parts.

Instead of the capsule there could be provided other substantially equivalent systems such as two spheres or cylinders It is obvious and natural to foresee that in the case of cylinders, the resilient action will be provided by one or the other of the threaded flanges 15, 16 which in this case must cooperate with some resilient means.

The spindle includes the so called cage 18 provided between the reel 217 and the balloon container 19.

The outlet sleeve 20 of the spindle 10 forms the upper head of the stationary part 11 of spindle 10 and has a head 21 which is to be found above the reel 217 and, the terry 124.

The head 21 has an external sleeve 22 which advantageously includes a lateral opening 122 in the vicinity of the chamber 27 where the capsule 16 is housed. The injector 31 can enter into chamber 27.

The head 21 has, in the example, an internal slidable body 23, the capsule 16 being of a variable length. The internal slidable body 23 cooperates with the threaded flange 15 to regulate the free length of the capsule 16 and thus the force exerted by the capsule 16 itself on the passing filament.

In the case where, for example, the equivalent cylinder is provided, such a slidable body can be elastically pressed in a known manner.

In the example, 24 is the internal body which is to be found in the stationary part of the spindle 10 downstream of the olive 16. Two threaded flanges 25 and 26 are positioned on either side of the capsule 16, 26 which is made, in the example, of hard anti-wear material, while 25 is positioned at one end of the slidable body 23.

The threaded flanges 25 and 26 form in a know way the two contact and thrust areas of the capsule 16 with the axial bore 14 and 114 for the passage of the filament. The form of the threaded flanges is such that a lateral displacement of the capsule 16 is automatically compensated and annulled.

The flanges 25 and 26 axially define the chamber 27 where the housing of the expansible capsule 16 is provided and where the injector, in the example, is inserted through opening 122.

The opening 122 can have a mobile section or plugging cover 28, cooperating with the external sleeve 22 for the closure of opening 122.

The mobile section 28, as provided, can be for instance circumferentially displaceable to permit entry of at least part of the head 32 of the injector 31 into the chamber 27.

For an autonomous actuation of injector 31 the thrust projection 29 is provided, in the example, in the mobile section 28, and cooperating with a special projection 42 provided in the injector 31.

Figure 3:
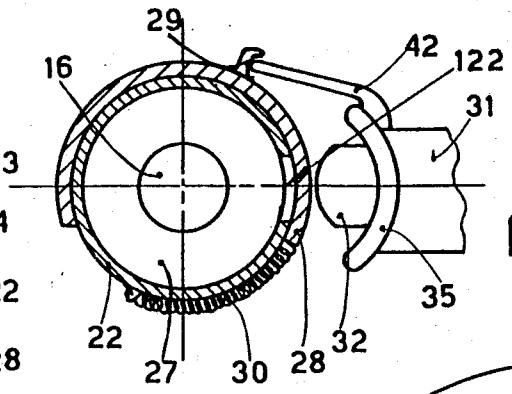
FIG. 3 is a cross-sectional view of the area of the spindle in which the injector operates.

In cooperation with the mobile section 28 spring means 30 can be provided which spring means 30 elastically determines the position of the mobile section 28 and permits (see example of FIG. 3) an injector 31 provided with a special projection 42 coacting with projection 29 to temporarily free the opening 122 so that the injector 31 can at least partially enter chamber 27.

The injector 31 is provided with a head 32 which has a beak 33 and can temporarily and at least partially penetrate into chamber 27, when the injector 31 is in the working position in order to prevent loss of pressure and vacuum in conduits 14 and 114.

The fluid conduit 134 at the inside of arm 38, can be advantageously of a diameter greater than that of conduit 14 for reducing pressure losses.

On arm 38 a projection 37 can be provided which serves to eventually actuate by hand the arm 38 itself.

The arm 38 connects the injector 31 to bench 40, or to other support means for the injector group, the arm can be pivoted to the bench 40 or on the balloon container 19, or on a support provided in the vicinity of container 19 or bench 40.

The arm 38 moves in a horizontal or semihorizontal plane and permits the injector 31, connected thereto, to position itself in at least two positions one of rest (when the injector 31 does not cooperate with the chamber 27 of the spindle); and one of work (when the injector 31 cooperates with the chamber 27 of the spindle 10).

Figure 2:
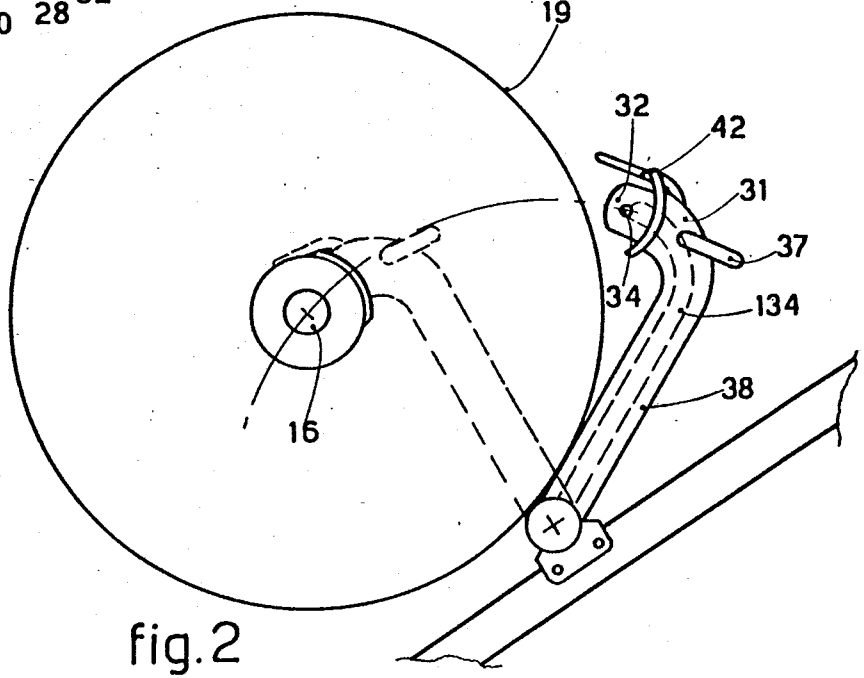
FIG. 2 is a top plan view of FIG. 1.
Figure 4:
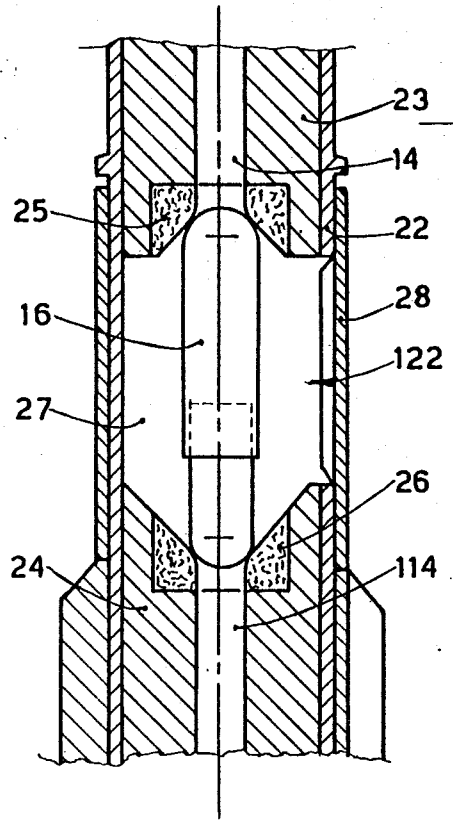
FIG. 4 is a vertical section showing a possible chamber housing the capsule according to the invention.
Figure 9:
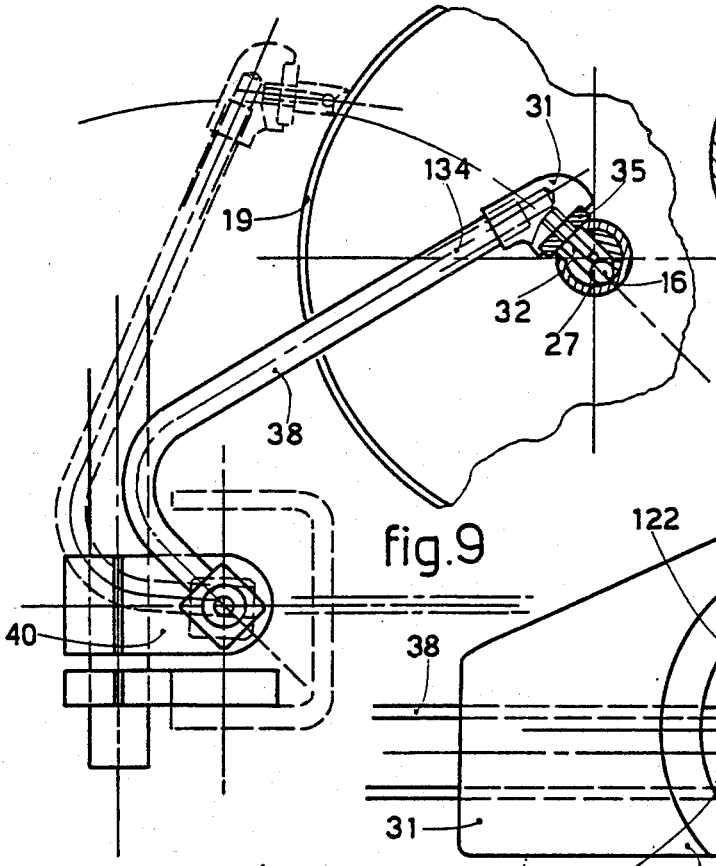
FIG. 9 shows a plan view of another embodiment of the invention.

In FIG. 2 the arm 38 is pivoted in the vicinity of the balloon 19, while in FIG. 9 it is pivoted in the vicinity of bench 40.

A conduit 41 is provided in cooperation with the arm 38 of the fluid injector 31 which allows the passage of the fluid into the injector 31 through the conduit 134, advantageously only when the injector 31 is in the working position.

The projection 42, during the displacement of the injector from the rest position to the operating position provides for temporarily displacing the mobile section 28 by pushing against the pin 29 provided on the mobile section 28 and allowing the head 32 of the injector 31 to find the opening 122 free so as to enter into chamber 27 of spindle 10.

The mobile section 28 is advantageously brought to the initial position by spring means 30 when the injector 31 is returned to the rest position.

Figure 11:
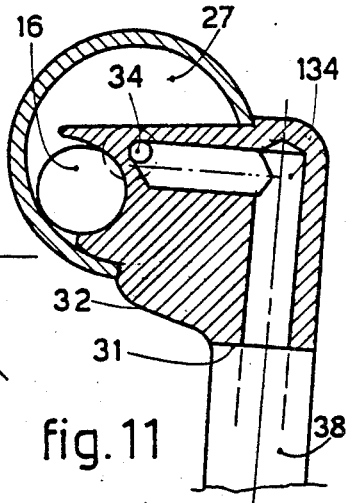
FIGS. 10 and 11 are two cross-sectional views of two injectors penetrating a double twisting spindle according to the invention.
Figure 10:
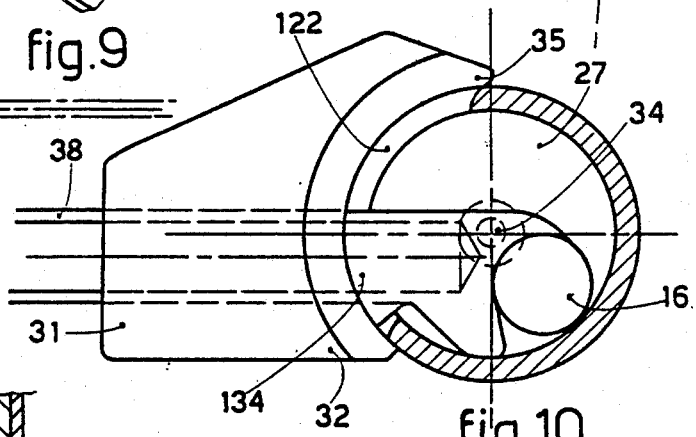

FIGS. 10 and 11 illustrate two non-restrictive examples, according to the invention, of injector heads 32 both provided in the annular section 35, the form of heads 32 is such that it occupies most of chamber 27, leaving the chamber only partially free.

This form permits the passage of the filament 17 without difficulty only in the free area thereby avoiding the gathering of the filament around the injector in which case such filament collapses.

Furthermore, the form of the head 32 of the injector 31 is such that the capsule 16 is confined in the right manner.

Figure 7:
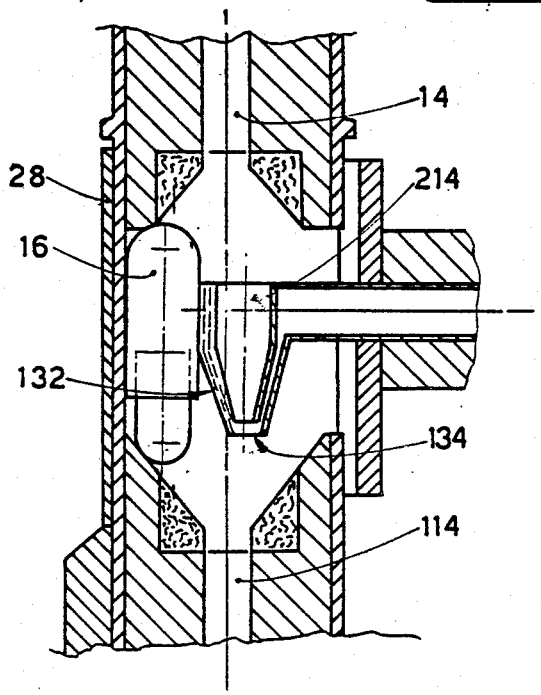
FIGS. 7 and 8 show a vertical section and a plan view of an embodiment of the invention in which the injector is of the venturi nozzle type.
Figure 8:
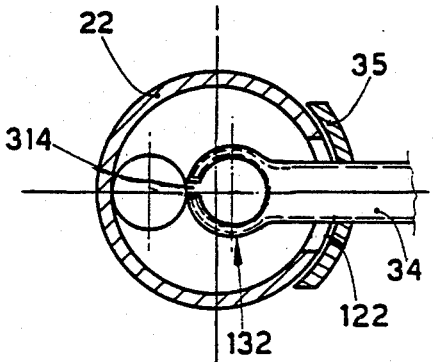

In FIGS. 7 and 8, the injector 32 is replaced by an injector head 132 which acts as a venturi nozzle. In fact the pressurized fluid arrives from the conduit 134 to the head 132 and from there leaves through the annular hole 134 cooperating with the internal conduit 214, that allows the creation in 214 of a negative pressure due to the venturi effect, a negative pressure which mainfests itself also in 13.

The head 132 has a louver 314 from which the filament, threaded through the bore 214, can disengage itself from the head 132 since the latter returns into the rest position.

Figure 6:
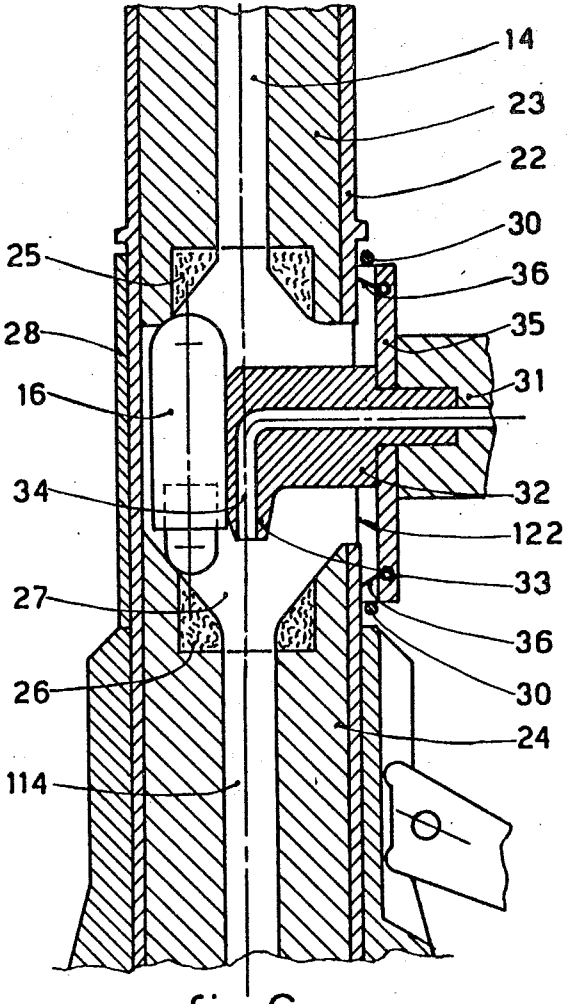
FIG. 6 is a vertical section of another embodiment of the injector in the form of an injector nozzle.
Figure 5:
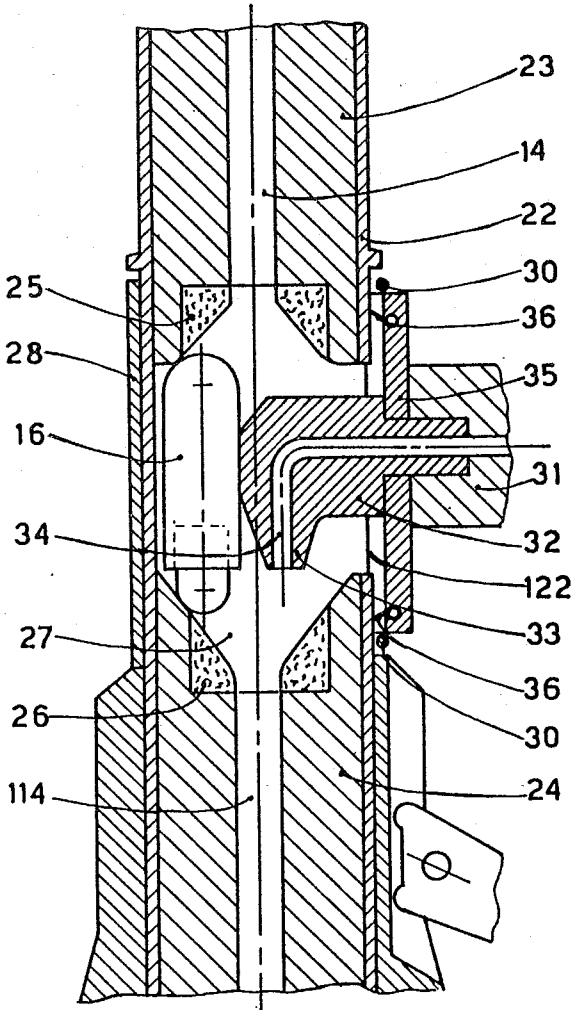
FIG. 5 is a vertical section showing an embodiment of the injector in the form of an injector nozzle.

In FIGS. 5 and 6 two more embodiments of the heads 32 of the injector 31, according to the invention, can be seen.

In FIG. 5, the axis of the conduit 34 for the fluid's passage is staggered with respect to the axis of transit bore 14 and 114. The axis of conduit 34 is envisaged in the vicinity of the circumferential part of bore 14 and 114.

In this case the fluid under pressure sucks in the filament 17 and drags it along the bore 114 in the immediate neighbourhood of the wall.

In FIG. 6, the conduit 34 is substantially coaxial with the axial transit bore 14-114.

In this case the fluid (as in a venturi) allows the filament 17 to run in the central part of the conduit 114 during the threading of the spindle 10.

Let's now look into the functioning of at least one solution of the present invention.

In order to thread the filament 17, the terminal end of filament 17 is first brought into the vicinity of the mouth 13 of the spindle 10.

By acting then on arm 38, or on the projection 37 connected thereto, one provides for the rotation of arm 38 itself, and of the injector 31 connected thereto, from the idle position to the working position.

Such rotation can be done manually or mechanically or in a hybrid manner.

In the case of FIG. 1 when the injector 31 is in the vicinity of spindle 10 or when the head 32 of injector 31 starts the penetration phase into chamber 27, the conduit 41 enters into cooperation with chamber 39 containing fluid under pressure, allowing the passage of the fluid into the conduit 134 and 34.

In the meantime, the projection 42 has already entered into contact with the pin 29 advantageously fixed to the mobile section 28.

This causes section 28 to displace circumferentially freeing the mouth 122.

Continuing the rotation of the injector 31 from the idle position to the working one, the head 32 penetrates into chamber 27 through the opening 122 advantageously situated in the sleeve 22.

The capsule or bead 16 which finds itself positioned, substantially even if not necessarily, at the center of chamber 27, is displaced sideway to free temporarily and at least partially the contact areas 25 and 26 between capsule 16 and the axial transit hole 14 and 114.

When the injector 32 is in position, the fixed section 35 comes into contact with the external sleeve 22 closing the aperture.

In chamber 27 and in the axial transit bore 14 and 114 due to the exit of the pressurized fluid from the conduit 34 of injector 31, a negative-positive pressure effect is generated which allows the filament to pass through the entire axial transit bore 14 and 114 and emerge from the exit 113.

The eventual hermetic means 36 advantageously cooperating with the fixed section 35 prevents leakage of fluid from or into the chamber 27.

When threading is accomplished, the injector 31 is moved to the idle position by simply rotating the arm 38 to which it is connected.

In the course of this operation, the conduit 41, advantageously, is not traversed by the fluid which remains enclosed in the chamber 39.

At the same time the mobile section 28, is brought into the position of closing aperture 122 by means of spring means 30 and the capsule 16 automatically reassumes its position in the central part of chamber 27 due to the geometric form of seatings 25 and 26 and the heads of the capsule 16 itself.

Some examples of the invention have been described but variants are possible for a person skilled in the art without going beyond the ambit of the invention concept.

It is thus possible to change proportions and dimensions and it is possible to add or substitute parts among themselves or with other similar parts. It is possible to utilize whichever type of capsule 16 or other means suitable for creating the tension required by filament 17. It is possible to provide one or more injectors 13 of a different form. It is possible not to envisage a mobile section 28. It is also possible to envisage different means for the delivery of the pressurized fluid into injector 31 when this is in position. It is possible to provide means equivalent to the mobile sector 28. It is possible to provide for the use of the invention also on non-double twisting spindles or on different double twisting spindles whether horizontal, vertical, inclined or similar. It is possible to provide different anchorage means for the injector 31 in different parts of the spindle 10. It is possible to make use of the aperture for rapid replacement of the expansible capsule 16 with a great economy of time by using only simple double pliers even elastically insertable through aperture 122.

These and other variants are within the ambit of the inventive concept as disclosed herein.

We claim:

1. An automatic take-in device for a double twisting spindle including a spindle body having a bore through which a filament is threaded, a supply reel fitting over said spindle body, said bore having a lateral opening therein above said reel, said bore at said opening defining a chamber inside said body and a tensioning means in said chamber for tensioning said filament being twisted which tensioning means is capable of temporarily freeing said filament bore during the threading stage of said filament comprising an injector for fluid under pressure temporarily insertable into said chamber through said lateral opening and at least partially displacing said tensioning means to free said bore.

2. An automatic take-in device for double twisting spindles as in claim 1, wherein said injector includes an injector head with a conduit for the passage of fluid under pressure, said fluid under pressure issuing from said conduit into said bore when at least part of said injector head is positioned through said opening into said bore.

3. An automatic take-in device for double twisting spindles as in claim 1, wherein said injector includes an injector head in the shape of a venturi with a conduit for the passage of a fluid under pressure and a conduit for the passage of fluid under negative pressure, the said injector head having a louver for freeing the fed filament, the outlet axis of the fluid under pressure cooperating with the bore downstream of the opening and the inlet axis of the fluid under negative pressure cooperating with the bore upstream of said opening.

4. The automatic take-in device for double twisting spindles as in claim 1, wherein said injector head occupies at least part of the cross-section of the chamber.

5. The automatic take-in device for double twisting spindles as in claim 1, wherein said injector head occupies part of the cross-section of said chamber leaving free one portion thereof on one side only.

6. The automatic take-in device for double twisting spindles as in claim 1, wherein said injector includes a plugging collar including auxiliary sealing means cooperating with said opening when said injector is inserted into said chamber.

7. A double twisting spindle comprising a spindle body having a filament passage therethrough and a chamber therein and means for tensioning a filament being twisted which means is capable of temporarily freeing the filament passage during the threading stage of said filament, said chamber having a lateral aperture, take-in means defining an injector positioned to move through said aperture into said chamber, said means for tensioning the filament being twisted temporarily and at least partially displaceable by said injector when said injector is in said chamber.

8. The double twisting spindle as in claim 7 including a movable closure for said aperture.

9. The double twisting spindle as in claim 7, wherein said tensioning means consists of an expansible capsule replaceable through the aperture.

* * * * *